US008147286B2

(12) United States Patent
Messina

(10) Patent No.: US 8,147,286 B2
(45) Date of Patent: Apr. 3, 2012

(54) PERSONAL SAFETY DEVICE

(76) Inventor: Philip Messina, Lindenhurst, NY (US)

( * ) Notice: Subject to any disclaimer, the term of this patent is extended or adjusted under 35 U.S.C. 154(b) by 198 days.

(21) Appl. No.: 12/465,681

(22) Filed: May 14, 2009

(65) Prior Publication Data

US 2009/0325436 A1 Dec. 31, 2009

Related U.S. Application Data

(60) Provisional application No. 61/127,954, filed on May 16, 2008, provisional application No. 61/096,025, filed on Sep. 11, 2008.

(51) Int. Cl.
*B63C 9/00* (2006.01)

(52) U.S. Cl. ..... 441/80

(58) Field of Classification Search ..... 441/80, 441/87, 88, 106, 108, 113, 129, 131, 132; 119/801; 440/101
See application file for complete search history.

(56) References Cited

U.S. PATENT DOCUMENTS

| | | | | |
|---|---|---|---|---|
| 5,066,013 | A * | 11/1991 | Kubota | 119/801 |
| 5,947,782 | A * | 9/1999 | Siladke et al. | 441/129 |
| 5,971,823 | A | 10/1999 | Sanso | |
| 6,089,449 | A | 7/2000 | Butterworth | |
| 6,482,058 | B2 | 11/2002 | Sanso et al. | |
| 6,790,112 | B2 * | 9/2004 | Kirk | 441/129 |
| 7,044,858 | B1 | 5/2006 | Otto et al. | |
| 2007/0117688 | A1 | 5/2007 | Sewitch, Jr. et al. | |

* cited by examiner

*Primary Examiner* — Daniel Venne
(74) *Attorney, Agent, or Firm* — Carter, DeLuca, Farrell & Schmidt, LLP

(57) ABSTRACT

A safety device includes an elongate tubular member formed of a buoyant material having gripping surfaces disposed on distal and proximal ends thereof. The elongate tubular member is positionable between initial and second positions. First and second appendages are disposed in mechanical cooperation with the proximal and distal ends of the elongate tubular member. A tether assembly is operably associated with the elongate tubular member and includes one or more couplings and a tether for releasably fixing the elongate tubular member in one or more second positions.

18 Claims, 3 Drawing Sheets

PERSONAL SAFETY DEVICE

CROSS REFERENCE TO RELATED APPLICATIONS

This application claims priority to, and the benefit of, U.S. Provisional Patent Application Ser. No. 61/127,954, filed May 16, 2008, and U.S. Provisional Patent Application Ser. No. 61/096,025, filed Sep. 11, 2008, the disclosures of which are hereby incorporated by reference in their entirety.

BACKGROUND

1. Technical Field

The present disclosure relates to a device and methods for nonviolent defense and training against violent persons and a device for use during water activities. In particular, the device may be utilized to intervene in violent conflicts, to cradle, restrain or separate persons, to immobilize persons, to protect persons from other instruments, to disarm others, and to provide water safety during water activities.

2. Description of Related Art

School teachers, paramedics, counselors, lifeguards, law enforcement officers, security personnel, psychiatrists and psychotherapists and similar persons in authority often are required to restrain, defend against or separate violent persons, or even immobilize persons suffering from loss of motor control during seizures or other medical or drug induced incidents. As such, these individuals rely on non-lethal devices to protect and preserve themselves and others without unnecessarily jeopardizing the public safety. Such devices include handcuffs, straitjackets, blanket wraps, pepper spray, etc., that have long been used to physically restrain individuals. Time and circumstance dictate the use of the appropriate device. Teachers, for example, are often required to separate students engaged in violent conflict and oftentimes are required to physically intervene, having only their own body for protection. An arresting law enforcement officer, on the other hand, may use handcuffs and/or hog-tying to restrain both the hands and/or feet of the arrested individual.

In any event, flailing, kicking, or other violent movements, can prove most difficult to any intervening individual. Indeed, a high level of manual restraint against the violent persons is frequently required before the violent person can be subdued, often resulting in further injury to the violent person, bystanders and/or the intervening individual.

A lifeguard may encounter violent conflicts and otherwise dangerous situations both on land and in water. On the beach or at a pool, situations that the lifeguard may deal with are similar to those discussed above with respect to teachers. In water, however, circumstances change significantly, specifically with water rescue. Persons of all ages and aquatic capabilities engage in a variety of water activities including swimming, surfing, snorkeling, kayaking, boogie-boarding, etc. In performing these activities, people tend to rely on life jackets, buoys, kickboards, etc. Although certain activities, extreme surfing for example, can produce greater risk, any activity performed in water has the potential for personal injury or even death. Therefore, a continued need to rely on water safety devices exists. In particular, a device which could provide an individual the ability to suppress quarrels and which could provide water safety during water activities would be very desirous.

SUMMARY

Accordingly, the present disclosure is directed to a safety device including an elongate tubular member, a first appendage, and a second appendage. The elongate tubular member defines a longitudinal axis and has distal and proximal ends. The elongate tubular member is positionable between an initial position and at least one second position. The elongate tubular member is configured to bias towards the initial position. The elongate tubular member may be disposed in a trapped condition when the elongate tubular member is positioned in at least one second position. At least a portion of the elongate tubular member may cross another portion of the elongate tubular member in at least one second position. The elongate tubular member may be disposed in a wrapped condition when the elongate tubular member is positioned in at least one second position. The elongate tubular member is substantially U-shaped in the wrapped condition. At least one of the distal and proximal ends of the elongate tubular member is tapered. The elongate tubular member is formed of a buoyant material.

A first appendage is disposed in mechanical cooperation with the proximal end of the elongate tubular member transverse to the longitudinal axis thereof. At least a portion of the first appendage extends beyond the outer surface of the elongate tubular member.

A second appendage is disposed in mechanical cooperation with the distal end of the elongate tubular member transverse to the longitudinal axis thereof. At least a portion of the second appendage extends beyond the outer surface of the elongate tubular member.

The safety device further comprises a tether assembly having a proximal end operably associated with at least one of the distal and proximal ends of the elongate tubular member. The tether assembly is configured to releasably fix the elongate tubular member in the at least one second position.

The tether assembly includes at least one coupling disposed in mechanical cooperation with at least one of the distal and proximal ends of the elongate tubular member and at least one tether operably associated with the other of the distal and proximal ends of the elongate tubular member, wherein the at least one tether is configured to couple to the at least one coupling. A proximal end of the tether is mounted to a first coupling and a distal end of the tether is configured to releasably couple to a second coupling for keeping the elongate tubular member in the at least one second position. The elongate tubular member includes at least one gripping surface operably associated with at least one of the distal and proximal ends of the elongate tubular member. The at least one gripping surface may be tapered for smaller hands. The tether assembly may be configured to releasably couple to a second safety device.

In one aspect of the present disclosure, a safety device includes an elongate tubular member formed of a buoyant material having gripping surfaces disposed on distal and proximal ends thereof. The elongate tubular member is positionable between an initial position and at least one second position, wherein the distal and proximal ends of the elongate tubular member are disposed in convergent relation relative to the initial position in the at least one second position. A first appendage is disposed in mechanical cooperation with the proximal end of the elongate tubular member. A second appendage is disposed in mechanical cooperation with the distal end of the elongate tubular member. A tether assembly is operably associated with the elongate tubular member that includes at least one coupling disposed in mechanical cooperation with at least one of the distal and proximal ends of the elongate tubular member and at least one tether operably associated with the other of the distal and proximal ends of the elongate tubular member. At least one tether is configured to couple to the end of at least one coupling. The tether assembly is configured to releasably fix the elongate tubular member in the at least one second position. The at least one second position may be substantially U-shaped. A proximal end of the tether is mounted to a first coupling and a distal end of the tether is configured to releasably couple to a second coupling for keeping the elongate tubular member in the at least one second position.

In another aspect of the present disclosure, a method of using a safety device includes the step of: providing a safety device, comprising: an elongate tubular member formed of a buoyant material having gripping surfaces disposed on distal and proximal ends thereof, wherein the elongate tubular member is positionable between an initial position to at least one second position, wherein the distal and proximal ends of the elongate tubular member are disposed in convergent relation relative to the initial position in the at least one second position; a first appendage disposed in mechanical cooperation with the proximal end of the elongate tubular member; a second appendage disposed in mechanical cooperation with the proximal end of the elongate tubular member; and a tether assembly operably associated with the elongate tubular member that includes at least one coupling disposed in mechanical cooperation with at least one of the distal and proximal ends of the elongate tubular member and at least one tether operably associated with the other of the distal and proximal ends of the elongate tubular member, wherein at least one tether is configured to couple to at least one coupling. The method further comprises the steps of: selectively gripping at least one of the gripping surfaces; selectively positioning the elongate member between an initial position and at least one second position; selectively positioning the safety device around at least one person; and selectively coupling at least one tether to at least one coupling.

BRIEF DESCRIPTION OF THE DRAWINGS

The above and other aspects and features of the present disclosure will become more apparent in light of the following detailed description when taken in conjunction with the accompanying drawings in which.

DETAILED DESCRIPTION OF EMBODIMENTS

Figure 1:
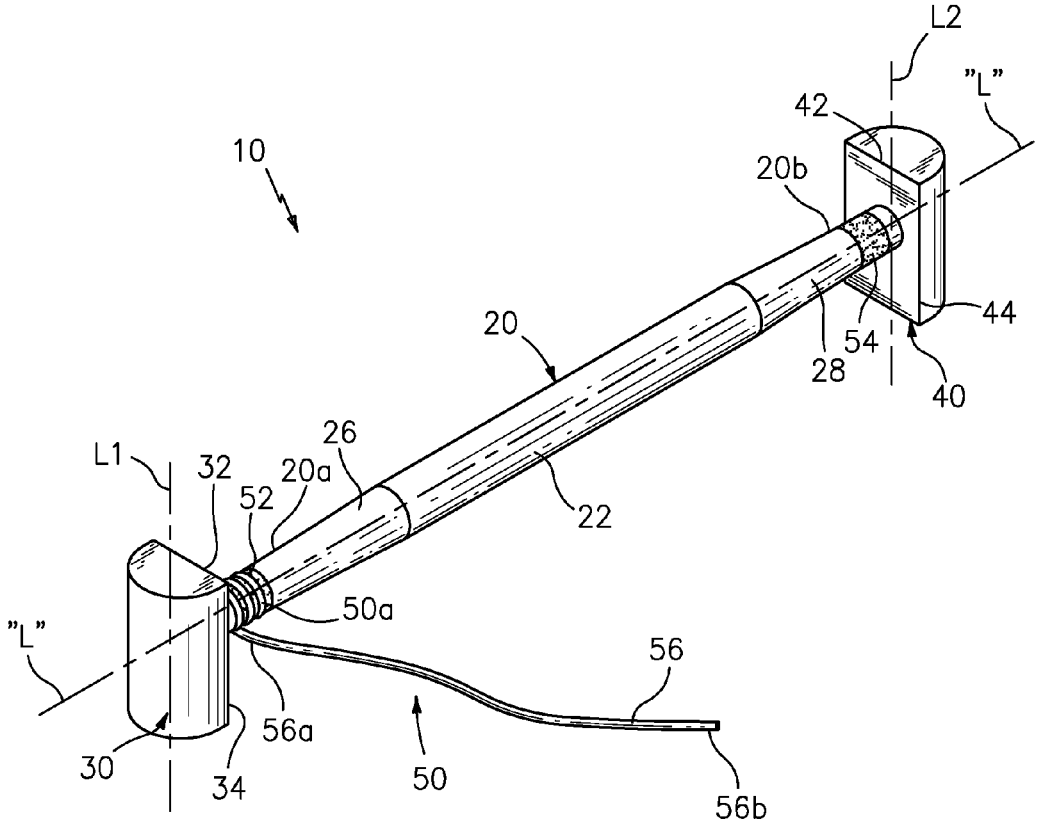
FIG. 1 is a perspective view of one embodiment of a safety device shown in an initial position in accordance with the present disclosure.

Particular embodiments of the present disclosure will be described herein with reference to the accompanying drawings. As shown in the drawings and as described throughout the following description, and as is traditional when referring to relative positioning on an object, the term "proximal" refers to the end of the device that is closer to the user and the term "distal" refers to the end of the device that is farther from the user. In the following description, well-known functions or constructions are not described in detail to avoid obscuring the present disclosure in unnecessary detail.

Referring now to the drawings, in which like reference numerals identify identical or substantially similar parts throughout the several views, FIG. 1 illustrates a safety device 10. In accordance with the present disclosure, the safety device 10 includes an elongate tubular member 20, a first appendage 30, and a second appendage 40. The elongate tubular member 20 defines a longitudinal axis "L" and has distal and proximal ends 20*a*, 20*b*. The elongate tubular member 20 may be made from any suitable flexible and buoyant material known in the art such as for example, polyethylene foam, silicone, plastic, foam rubber, rubber polyurethane, or other like material with similar properties. The first and/or second appendage 30, 40 may be formed of the same material as the elongate tubular member 20. For example, the elongate tubular member 20 may be formed from polyethylene No. 2 to No. 4 density foam with a rubberized coating on both ends joining first and second appendages 30, 40 of the same material. The elongate tubular member 20 includes one or more gripping surfaces 26, 28 operably associated with the distal and proximal ends 20*a*, 20*b* of the elongate tubular member 20. The gripping surfaces 26, 28 may be tapered.

In embodiments, the length of the device may be from about 50 inches to about 75 inches, from about 53 inches to about 70 inches, and in other embodiments, from about 55 inches to about 60 inches. In embodiments, the diameter of the elongate tubular member may be from about 1 inch to about 5 inches, from about 1.5 inches to 3.5 inches, and in other embodiments, from about 2 inches to about 3 inches. The first appendage 30 is secured to the proximal end 20*a* of the elongate tubular member 20 transverse to the longitudinal axis "L" for providing protection to a user's hand, or stunning or blocking an aggressor. More particularly, as illustrated in FIG. 1, the first appendage 30 defines a first longitudinal axis "L1" which is transverse to the longitudinal axis "L" of the elongate tubular member 20. One or more portions 32, 34 of the first appendage 30 or hand protector extend beyond the outer surface 22 of the elongate tubular member 20.

With continued reference to FIG. 1, the second appendage 40 is secured to the distal end 20*b* of the elongate tubular member 20 transverse to the longitudinal axis "L" for providing protection to a user's hand or stunning an aggressor. More particularly, as illustrated in FIG. 1, the second appendage 40 defines a second longitudinal axis "L2" which is transverse to the longitudinal axis "L" of the elongate tubular member 20. One or more portions 42, 44 of the second appendage 40 extend beyond the outer surface 22 of the elongate tubular member 20.

In embodiments, the first and second appendages 30, 40 may have a length of from about 2 inches to about 10 inches, from about 3 inches to about 8 inches, and in other embodiments, about 6 inches. The width of the first and second appendages may be from about 1 inch to about 5 inches, from about 1.5 inches to about 3.5 inches, and in other embodiments from about 2 inches to about 3 inches. The thickness of the first and second appendages may be from about 0.5 inches to about 4 inches, in embodiments, from about 1 inch to about 3 inches, in other embodiments, 1.5 inches.

Figure 2:
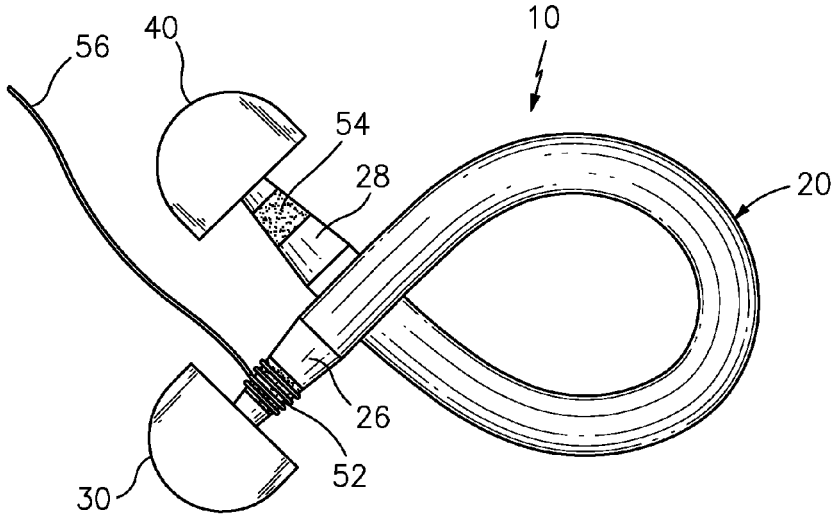
FIG. 2 is side elevational view of the safety device of FIG. 1 shown in a second position.
Figure 3:
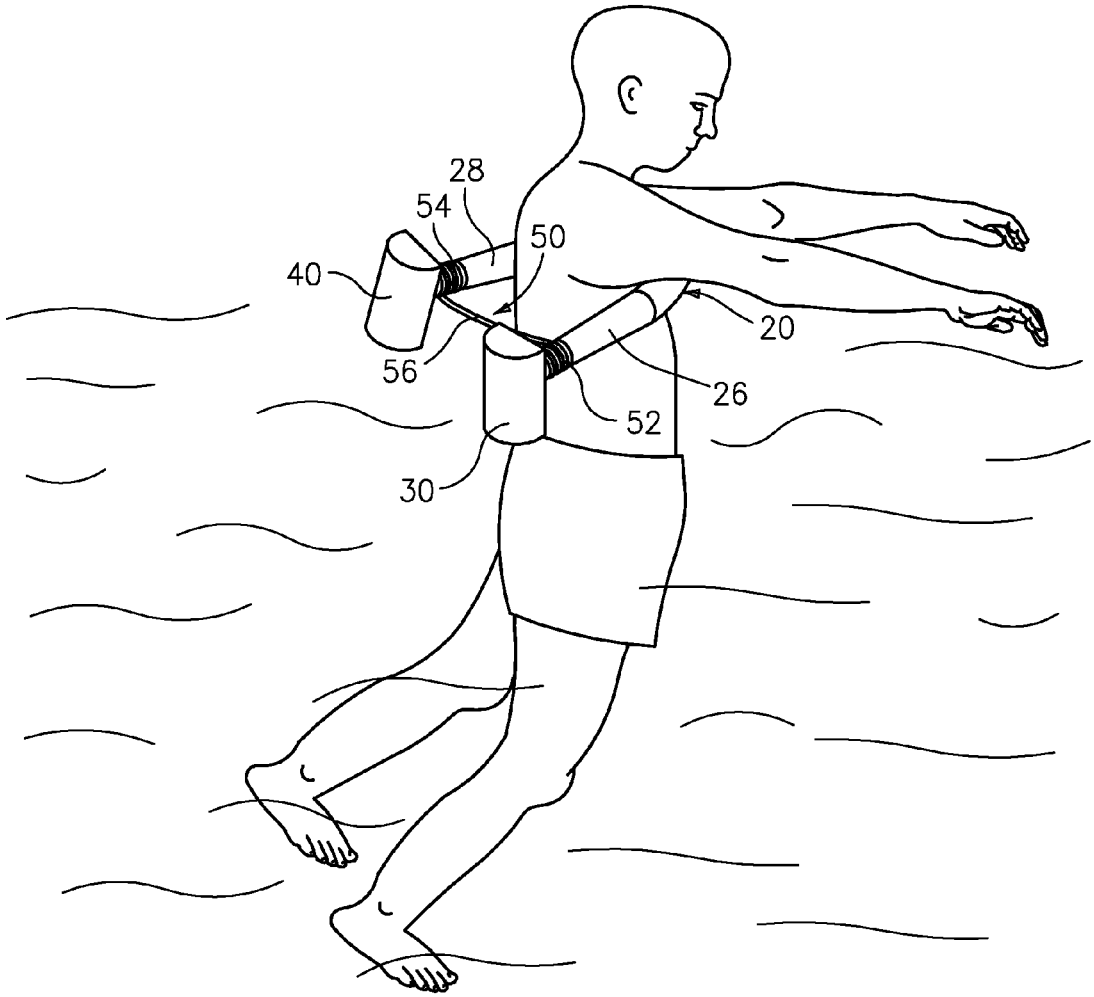
FIG. 3 is a perspective view of the safety device of FIGS. 1 and 2 being shown in another second position.

Referring again to FIG. 1, the safety device 10 further comprises a tether assembly 50 having a proximal end 50*a* operably associated with one or both of the distal and proximal ends 20*a*, 20*b* of the elongate tubular member 20. The tether assembly 50 is configured to releasably fix the elongate tubular member 20 in one or more second positions (FIGS. 2 and 3). By affixing the tether assembly, a user can controllably subdue an aggressor by entrapping them within the safety device 10, or can use the device to disarm weapons or other dangerous objects from an aggressor.

Figure 4:
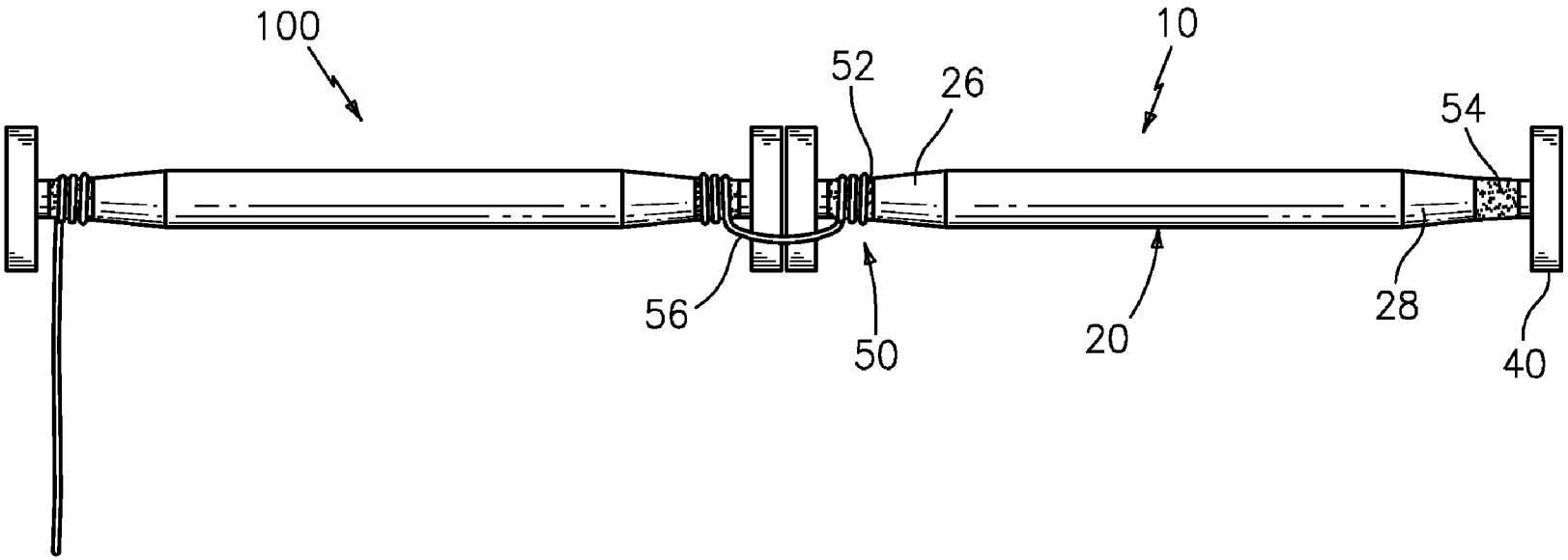
FIG. 4 is a side elevational view of the safety device of FIGS. 1-3 shown coupled to another safety device.

As illustrated in FIG. 1, the tether assembly 50 includes one or more couplings 52, 54 disposed in mechanical cooperation with the distal and proximal ends 20*a*, 20*b* of the elongate tubular member 20 and one or more tethers 56 operably associated with the distal and proximal ends 20*a*, 20*b* of the elongate tubular member 20. In embodiments, the tether assembly may be a band or strap having a hook and loop type configuration (e.g., Velcro) on one or more ends. Each tether 56 is configured to couple to each coupling 52, 54 via the hook and loop type configuration. A proximal end 56*a* of the tether 56 is mounted to a first coupling 52 and a distal end 56*b* of the tether 56 is configured to releasably couple to a second coupling 54 for keeping the elongate tubular member 20 in one or more second positions. The tether assembly 50 may be configured to releasably couple to a second safety device 100 as shown in FIG. 4. In embodiments, the tether assemblies may have a length of about 55 inches to about 75 inches, from about 15 inches to about 70 inches, and in other embodiments, from about 20 inches to about 65 inches.

In embodiments, the tether 56 may be used as a temporary restraining device for high risk situations. By attaching the tether 56 to the first coupling 52, the tether 56 may be tightened by simply rotating the safety device 10. In embodiments, the tether assembly 50 may be used as a tie around the neck and jaw of an aggressive attacker (not shown). In other embodiments, the tether assembly 50 may be used for towing a person in water rescue operations.

The elongate tubular member 20 may be positionable between an initial position (FIG. 1) and one or more second positions (FIGS. 2 and 3). The elongate tubular member 20 may be configured to bias towards the initial position. One example of a second position is shown in FIG. 2 where the elongate tubular member 20 may be disposed in a trapped condition for engaging or otherwise defending against an aggressor. As illustrated in FIG. 2, a portion of the elongate tubular member 20 crosses another portion of the elongate tubular member 20. Typically, a user will position the safety device 10 in the trapped condition around the neck and across the jaw line of an aggressor for controlling the aggressor's head. In this position, a user can protect against biting or spitting by directing the aggressor's head away from the user without causing excessive injury or trauma. Alternatively, a user may utilize the safety device 10 to protect against fluid transferred diseases, while diminishing the attacker's ability to strike his own head against hard objects.

Another second position is illustrated in FIG. 3 which shows the elongate tubular member 20 disposed in a wrapped condition. Since the elongate tubular member 20 may be formed of a buoyant material (i.e., the polyethylene foam described above), by positioning the safety device 10 in the wrapped condition, a user can position the safety device 10 around themselves or others for flotation. In this regard, the buoyant material may be selected to provide buoyancy for up to approximately 250 lbs or more. In the wrapped condition, the elongate tubular member 20 may be configured to be substantially U-shaped. Alternatively, positioning the safety device 10 in the wrapped condition allows a user to encircle and restrain an aggressor in violent conflict situations. Both of the distal and proximal ends 10*a*, 10*b* of the elongate tubular member 20 may be tapered and coated with a rubberized coating such as vinyl or other similar coating for easy gripping and manipulation of the elongate tubular member 20 into each of the second positions.

In embodiments, the safety device 10 can be used when front cuffing, i.e., when police have to handcuff in front, or when people are large and require additional resources for submission. In other embodiments, the safety device 10 can be used in psychiatric wards, prisons or the like for retaining or otherwise subduing individuals.

While several embodiments of the disclosure have been shown in the drawings, it is not intended that the disclosure be limited thereto, as it is intended that the disclosure be as broad in scope as the art will allow and that the specification be read likewise. Therefore, the above description should not be construed as limiting, but merely as exemplifications of presently disclosed embodiments. Thus the scope of the embodiments should be determined by the appended claims and their legal equivalents, rather than by the examples given.

What is claimed is:

1. A safety device, comprising:

an elongate tubular member defining a longitudinal axis that extends along the largest dimension of the elongate tubular member, the elongate tubular member having distal and proximal ends, wherein the elongate tubular member is positionable between an initial position and at least one second position;

a first appendage defining a first longitudinal axis that extends along the largest dimension of the first appendage, the first appendage secured to the proximal end of the elongate tubular member such that the first longitudinal axis is transverse to the longitudinal axis of the elongate tubular member, at least a portion of the first appendage extending beyond the outer surface of the elongate tubular member;

a second appendage defining a second longitudinal axis that extends along the largest dimension of the first appendage, the second appendage secured to the distal end of the elongate tubular member such that the second longitudinal axis is transverse to the longitudinal axis of the elongate tubular member, at least a portion of the second appendage extending beyond the outer surface of the elongate tubular member; and a tether assembly having a proximal end secured to at least one of the distal and proximal ends of the elongate tubular member.

2. The safety device according to claim 1 wherein at least one of the distal and proximal ends of the elongate tubular member is tapered.

3. The safety device according to claim 1 wherein the elongate tubular member biases towards the initial position.

4. The safety device according to claim 1 wherein at least a portion of the elongate tubular member crosses another portion of the elongate tubular member in the at least one second position.

5. The safety device according to claim 1 wherein the tether assembly releasably fixes the elongate tubular member in the at least one second position.

6. The safety device according to claim 5 wherein the at least one second position is substantially U-shaped.

7. The safety device according to claim 1 wherein the tether assembly releasably couples to a second safety device.

8. The safety device according to claim 1 wherein the tether assembly includes at least one coupling secured to at least one of the distal and proximal ends of the elongate tubular member and at least one tether secured to the other of the distal and proximal ends of the elongate tubular member, wherein the at least one tether couples to the at least one coupling.

9. The safety device according to claim 8 wherein a proximal end of the tether is mounted to a first coupling and a distal end of the tether releasably couples to a second coupling for keeping the elongate tubular member in the at least one second position.

10. The safety device according to claim 1 wherein the elongate tubular member includes at least one gripping surface positioned on at least one of the distal and proximal ends of the elongate tubular member.

11. The safety device according to claim 10 wherein the at least one gripping surface is tapered.

12. The safety device according to claim 1 wherein the elongate tubular member is formed of a buoyant material.

13. The safety device according to claim 12, wherein the buoyant material provides at least approximately 250 lbs of buoyancy.

14. The safety device according to claim 1, wherein at least one of the first and second appendages are formed of the same material as the elongate member.

15. The safety device according to claim 1, wherein the safety device is substantially I-shaped.

16. A safety device, comprising:

an elongate tubular member defining a first longitudinal axis and having opposed ends, wherein the elongate tubular member is positionable between a first position and at least one second position;

at least one appendage secured to each of the opposed ends of the elongate tubular member, the at least one appendage defining a second longitudinal axis that is transverse to the first longitudinal axis of the elongate tubular member, the second longitudinal axis extending along the largest dimension of the at least one appendage, at least a portion of the at least one appendage extending beyond the outer surface of the elongate tubular member; and a tether secured to the elongate tubular member, wherein the tether releasably fixes the elongate tubular member in the at least one second position.

17. The safety device according to claim 16 wherein a proximal end of the tether is mounted to a first coupling and a distal end of the tether releasably couples to a second coupling for keeping the elongate tubular member in the at least one second position.

18. A safety device system, comprising:

a first safety device and a second safety device, at least one of the first and second safety devices including:

an elongate tubular member defining a first longitudinal axis and having opposed ends, wherein the elongate tubular member is positionable between a first position and at least one second position;

at least one appendage secured to each of the opposed ends of the elongate tubular member, the at least one appendage defining a second longitudinal axis that is transverse to the first longitudinal axis of the elongate tubular member, the second longitudinal axis extending along the largest dimension of the at least one appendage, at least a portion of the at least one appendage extending beyond the outer surface of the elongate tubular member; and a tether secured to the elongate tubular member, wherein the tether releasably couples the first and second safety devices together.

* * * * *